US011306957B2

(12) United States Patent
Barker

(10) Patent No.: US 11,306,957 B2
(45) Date of Patent: Apr. 19, 2022

(54) LIQUID NITROGEN-BASED COOLING SYSTEM

(71) Applicant: The Tisdale Group, Lebanon, TN (US)

(72) Inventor: Donald Wade Barker, Lebanon, TN (US)

(73) Assignee: The Tisdale Group, LLC, Lebanon, TN (US)

( * ) Notice: Subject to any disclaimer, the term of this patent is extended or adjusted under 35 U.S.C. 154(b) by 0 days.

(21) Appl. No.: 16/253,553

(22) Filed: Jan. 22, 2019

(65) Prior Publication Data

US 2019/0226745 A1 Jul. 25, 2019

Related U.S. Application Data

(60) Provisional application No. 62/620,664, filed on Jan. 23, 2018.

(51) Int. Cl.
*F25B 9/00* (2006.01)
*F25B 9/02* (2006.01)
(Continued)

(52) U.S. Cl.
CPC ..... *F25D 3/10* (2013.01); *F25B 9/14* (2013.01); *F25J 3/04412* (2013.01);
(Continued)

(58) Field of Classification Search
CPC .... F25B 19/00; F25B 9/00; F25B 9/02; F25B 9/10; F17C 2227/0374; F17C 2227/0376;
(Continued)

(56) References Cited

U.S. PATENT DOCUMENTS 1,777,040 A * 9/1930 Wilhel ..... F17C 9/00 62/48.2
3,030,780 A * 4/1962 Loveday ..... F17C 3/08 62/48.3

(Continued)

FOREIGN PATENT DOCUMENTS

CN 104503505 A 4/2015
JP 5965281 B2 8/2016

OTHER PUBLICATIONS

Cosier et al., "A Nitrogen-Gas-Stream Cryostat for General X-ray Diffraction Studies", J. Appl. Cryst., Apr. 1986, vol. 19(2), pp. 105-107.

(Continued)

*Primary Examiner* — Jianying C Atkisson
*Assistant Examiner* — Erik Mendoza-Wilkenfel
(74) *Attorney, Agent, or Firm* — United IP Counselors, LLC

(57) ABSTRACT

A liquid nitrogen-based cooling system features a cooling circuit and a liquid nitrogen-based heat sink. Heat absorbed by fluid flowing in the cooling circuit is subsequently absorbed by liquid nitrogen within the heat sink, which causes the liquid nitrogen to vaporize. The vaporized nitrogen is condensed back to liquid form, e.g., by means of a helium-based cryo-refrigeration system. The heat-sink includes at least a first vessel that contains the liquid nitrogen, with the cooling circuit including a series of coils passing around the first vessel in heat-exchanging contact with an exterior surface thereof so that heat can be transferred into the liquid nitrogen. The first vessel and coils may be contained within a second, outer vessel that minimizes heat transfer from the ambient environment to the fluid flowing in the cooling circuit and the liquid nitrogen within the first vessel.

16 Claims, 4 Drawing Sheets

(51) Int. Cl.

| | |
|---|---|
| ***F25B 9/10*** | (2006.01) |
| ***F25D 3/10*** | (2006.01) |
| ***F25J 3/04*** | (2006.01) |
| ***F25B 9/14*** | (2006.01) |

(52) U.S. Cl.
CPC ... *F17C 2223/0161* (2013.01); *F25J 2210/42* (2013.01); *F25J 2270/904* (2013.01)

(58) Field of Classification Search
CPC ..... F17C 2227/0381; F17C 2227/0383; F17C 2227/0386; F17C 2227/0353; F17C 2223/013; F17C 2227/0367; F17C 2227/0369; F17C 2227/0395; F17C 2265/033; F17C 2265/034; F17C 2265/035; F25J 2270/912
See application file for complete search history.

(56) References Cited

U.S. PATENT DOCUMENTS 3,422,632 A * 1/1969 Currie ..... F25B 9/02 62/51.2
3,866,432 A 2/1975 Harrison
3,930,375 A * 1/1976 Hofmann ..... F17C 3/10 62/45.1
5,212,953 A * 5/1993 Kawaguchi ..... F17C 13/026 250/370.15
5,375,423 A 12/1994 Delatte
6,107,905 A * 8/2000 Itoh ..... F17C 3/085 335/216
6,438,969 B1 * 8/2002 Laskaris ..... F25B 25/00 62/51.1
6,438,994 B1 8/2002 Rashad et al.
6,732,536 B1 * 5/2004 Bonaquist ..... F25B 19/005 62/259.2
7,301,343 B1 * 11/2007 Sellers ..... G01R 33/28 324/318
7,559,205 B2 7/2009 Atkins et al.
9,841,228 B2 12/2017 Dickerson et al.
2005/0040251 A1 2/2005 Daly
2006/0048522 A1 * 3/2006 Yamada ..... F25B 25/005 62/6
2007/0163261 A1 7/2007 Strathman
2007/0240451 A1 10/2007 Fogarty et al.
2009/0071171 A1 * 3/2009 Zia ..... F17C 3/00 62/47.1
2009/0193817 A1 8/2009 Germain et al.
2012/0023969 A1 * 2/2012 Subramaniam ..... F25B 21/00 62/3.1
2013/0008188 A1 1/2013 McCormick et al.
2013/0333912 A1 * 12/2013 Yamamoto ..... F25B 9/14 174/15.5
2014/0202174 A1 * 7/2014 Wang ..... F25B 9/14 62/6
2014/0311591 A1 * 10/2014 Drube ..... F04B 37/08 137/340
2015/0300719 A1 10/2015 Strickland et al.
2016/0333241 A1 11/2016 Fukushima et al.
2017/0211862 A1 * 7/2017 Slack ..... F25B 30/02

OTHER PUBLICATIONS

Proux et al., "Feedback system of a liquid-nitrogen-cooled double-crystal monochromator: design and performances". Journal of Synchrotron Radiation, Jan. 2006, vol. 13(1), pp. 59-68.
International Search Report and Written Opinion dated Mar. 15, 2019 for International Patent Application No. PCT/US2019/014531.
International Preliminary Report on Patentability dated Aug. 6, 2020, issued in corresponding International Application No. PCT/US2019/014531.

* cited by examiner

LIQUID NITROGEN-BASED COOLING SYSTEM

CROSS-REFERENCE TO RELATED APPLICATIONS

This application is based on and claims the priority benefit of U.S. provisional application No. 62/620,664 filed Jan. 23, 2018, the contents of which are incorporated herein by reference.

1. FIELD OF THE INVENTION

In general, embodiments of the invention disclosed herein relate to cooling systems.

2. DESCRIPTION OF RELATED ART

In conventional cooling systems, a refrigerant circulates throughout the system. A cold mixture of liquid and gaseous refrigerant passes through an evaporator (i.e., a heat-exchanger), where the refrigerant absorbs heat from a device or region that is to be cooled as the liquid portion of the refrigerant vaporizes. The vapor-phase refrigerant is then compressed to a higher pressure, which raises its temperature, and is subsequently condensed back to the liquid phase by cooling it with air or water flowing across the refrigerant conduit, which removes from the system heat that has been removed from the device or region that has been cooled. The liquid-phase refrigerant then passes through an expansion valve, which allows part of the refrigerant to flash-evaporate, thereby lowering its temperature before it passes back to the evaporator to continue the cycle.

Although this cooling cycle is well-established technology, it has certain limitations. For instance, in applications where significant amounts of cooling capacity are required, the cooling cycle may not provide sufficient cooling without a great deal of bulky equipment and/or without requiring large amounts of electrical power—and hence money—to run the system.

SUMMARY OF THE INVENTION

A liquid nitrogen-based cooling system features a cooling circuit and a liquid nitrogen-based heat sink. Heat absorbed by a heat-absorbing medium circulating in the cooling circuit is subsequently absorbed by liquid nitrogen within the heat sink, which causes the liquid nitrogen to vaporize. The vaporized nitrogen is condensed back to liquid form, e.g., by means of a helium-based cryo-refrigeration system. The heat-sink includes at least a first vessel that contains the liquid nitrogen, with the cooling circuit including a series of coils passing around the first vessel in heat-exchanging contact with an exterior surface thereof so that heat can be transferred into the liquid nitrogen. The first vessel and the coils may be contained within a second, outer vessel that minimizes heat transfer from the ambient environment to the heat-absorbing medium flowing in the cooling circuit and the liquid nitrogen within the first vessel.

In a first aspect, the invention features a liquid nitrogen-based cooling system. The cooling system includes a heat sink containing a first heat-absorbing medium, i.e., a supply of liquid nitrogen, and a cooling circuit through which circulates a second heat-absorbing medium. The cooling circuit is arranged to absorb heat from a device or region to be cooled and is in heat-exchanging relationship with the heat sink. A refrigeration subsystem is arranged relative to the heat sink to condense vaporized nitrogen back into liquid nitrogen and return the condensed liquid nitrogen to the supply of liquid nitrogen. Suitably, the heat sink includes a first vessel containing the liquid nitrogen and a plurality of coils arranged in heat-transferring relationship with the liquid nitrogen, which coils form a portion of the cooling circuit through which the second heat-absorbing medium circulates.

In specific embodiments of the cooling system, the plurality of coils may pass around an exterior surface of the first vessel. Additionally, the first vessel and the coils may be disposed within a second, outer vessel, with at least a partial vacuum formed between the first and second vessels and at least a portion of the coils being disposed within the vacuum to inhibit unwanted heat transfer. The second heat-absorbing medium that circulates within the cooling system may include propylene glycol, with one or more anticorrosive agents.

In another aspect, the invention features a method for cooling a device or region of space requiring cooling. The method includes circulating a heat-absorbing medium within a cooling circuit and causing or allowing heat to be transferred to the heat-absorbing medium that is circulating within the cooling circuit. That heat is transported, via the heat-absorbing medium, to a heat sink containing a supply of liquid nitrogen, where the heat is subsequently transferred to the liquid nitrogen contained within the heat sink. This causes at least a portion of the liquid nitrogen to vaporize. Heat is then removed from the vaporized liquid nitrogen (and the overall system) to thereby cause the vaporized liquid nitrogen to condense back to liquid form, and the re-condensed liquid nitrogen is returned to the supply of liquid nitrogen contained within the heat sink.

We have found that cooling with systems and methods in accordance with the invention offers significant increases in efficiency and cost savings.

BRIEF DESCRIPTION OF THE DRAWINGS

These and other features of the invention will become clearer in view of the description below and the accompanying figures, in which.

DETAILED DESCRIPTION OF EMBODIMENTS

Figure 1:
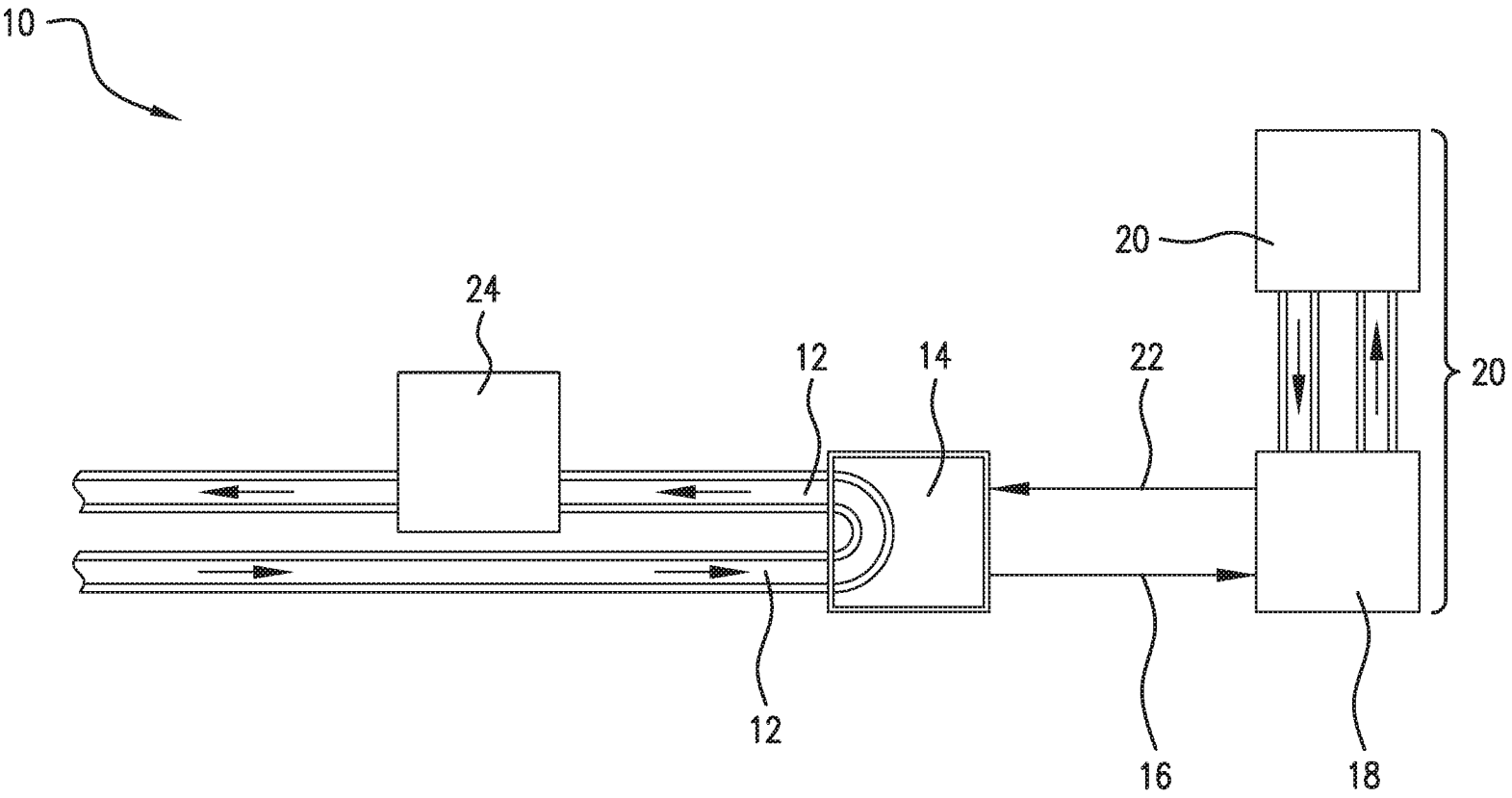
FIG. 1 is a schematic view illustrating an embodiment of a cooling system in accordance with the invention.

An embodiment of a cooling system 10 in accordance with the invention is illustrated in the figures. As illustrated in FIG. 1, such a cooling system 10 has a cooling circuit 12 through which heat-absorbing fluid flows and a liquid nitrogen-based heat sink 14. The heat-absorbing fluid circulating within the cooling circuit 12 absorbs heat from a device (e.g., a server rack or the moisture-condensing surface of an atmospheric water harvester) or area (e.g., a room or refrigerated cargo vehicle) that is to be cooled by means of a suitable heat-exchanger (not illustrated), and that absorbed heat is then transferred to liquid nitrogen contained within the heat sink 14. As the liquid nitrogen absorbs heat, it partially vaporizes into a headspace within the heat sink 14, as indicated schematically by arrow 16. The vaporized nitrogen is cooled on the "cold head" portion 18 of a helium-based cryo-refrigeration system 20 (i.e., a refrigeration subsystem), e.g., as available from Cryomech, Inc., in Syracuse, N.Y., which causes it to condense back into liquid form as indicated schematically by arrow 22. Suitably, the heat-absorbing fluid flowing in the cooling circuit 12 is a mixture of propylene glycol and one or more anticorrosive agents, e.g., inhibited propylene glycol available from Chemworld in Roswell, Ga. (80%-100% propylene glycol with potassium hydroxide (<1%) and sodium molybdate (<1%)), and a conventional fluid-circulating pump 24 (e.g., a water pump) is provided in the cooling circuit 12 to circulate the propylene glycol fluid through the circuit 12.

Figure 3:
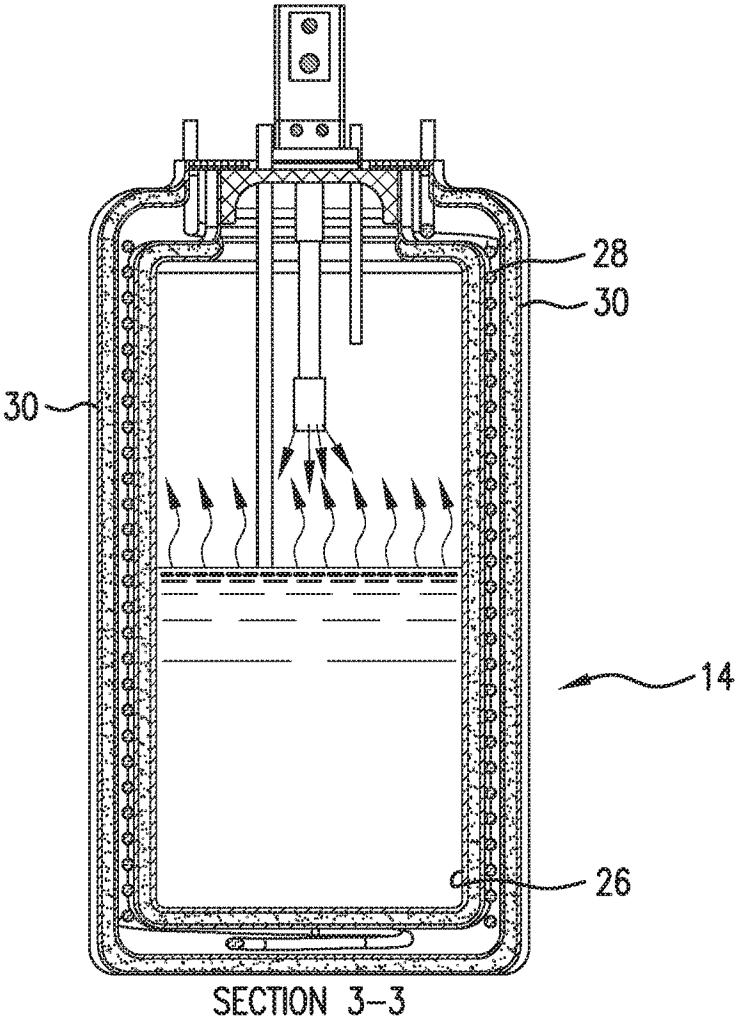
FIG. 3 is a section view taken along the lines 3-3 in FIG. 2.
Figure 2:
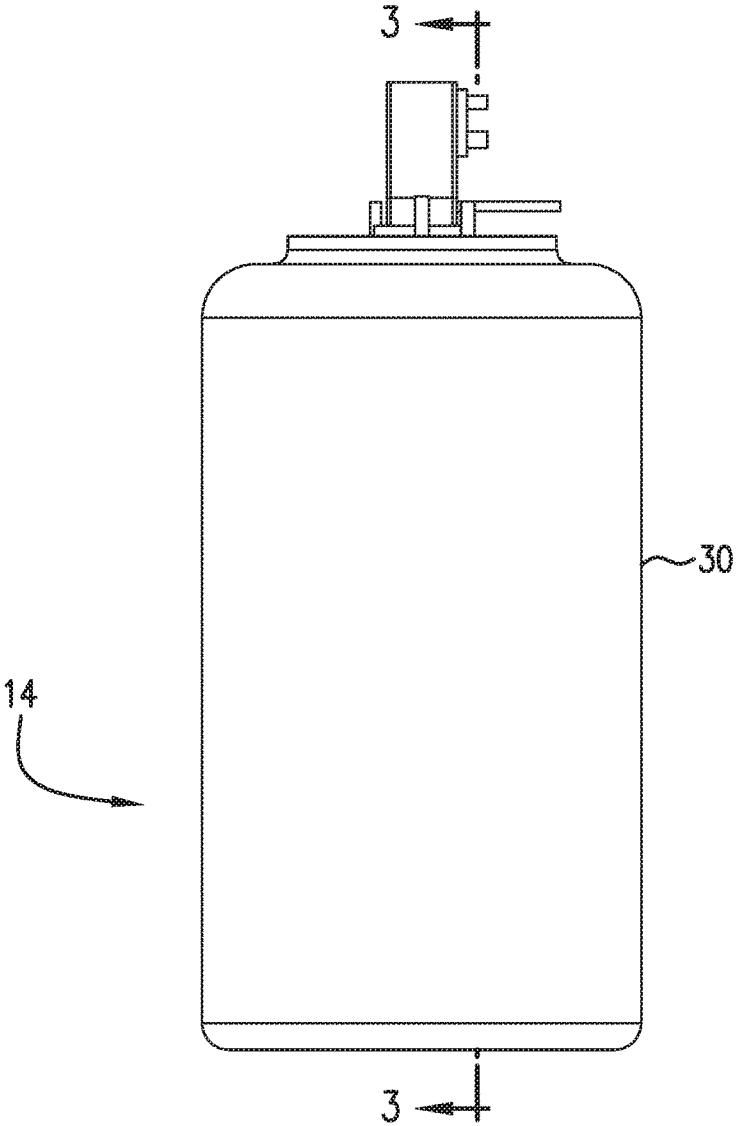
FIG. 2 is an elevation view of the primary heat sink used in the cooling system illustrated in FIG. 1.
Figure 5:
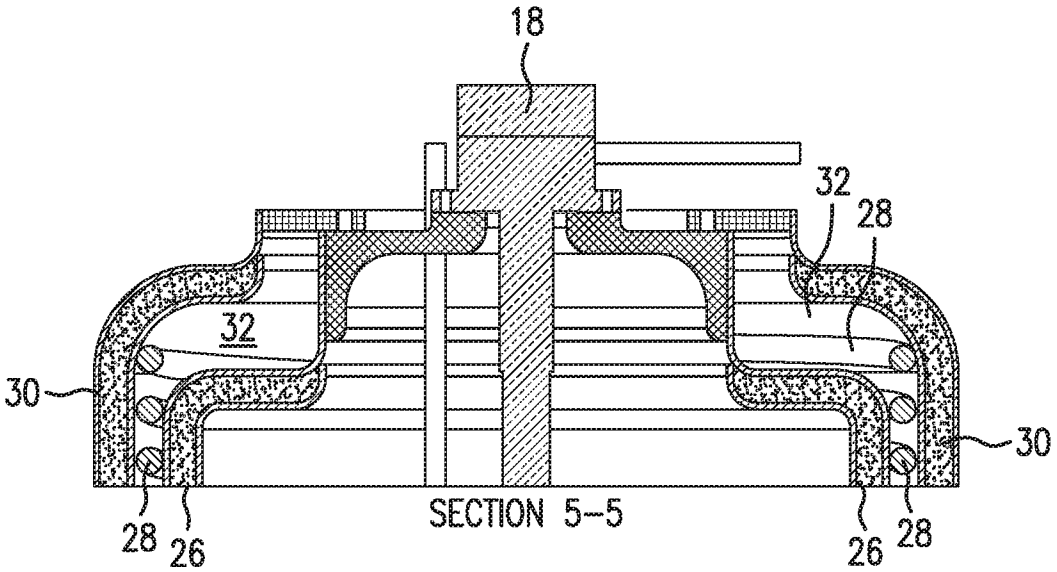
FIG. 5 is a partial section view taken along the lines 5-5 in FIG. 4.
Figure 4:
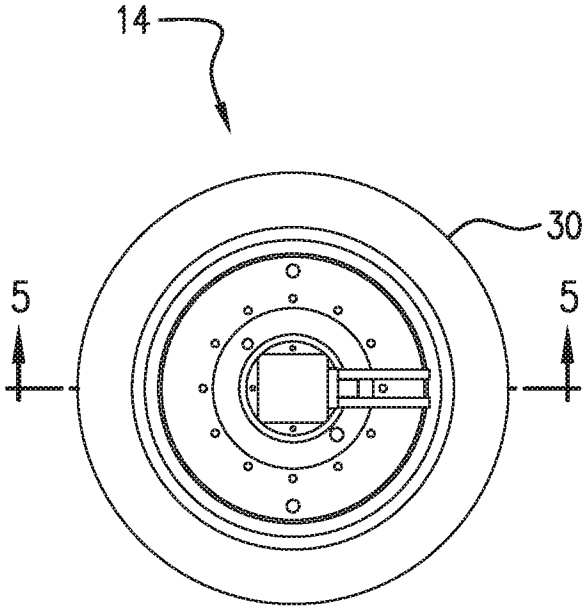
FIG. 4 is a top view of the primary heat sink used in the cooling system illustrated in FIG. 1.
Figure 6:
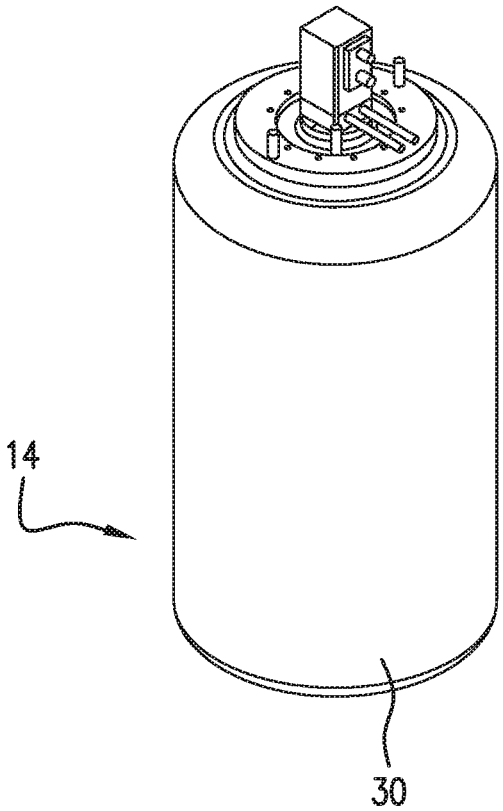
FIG. 6 is a perspective view of the primary heat sink shown in FIGS. 1 and 2.
Figure 7:
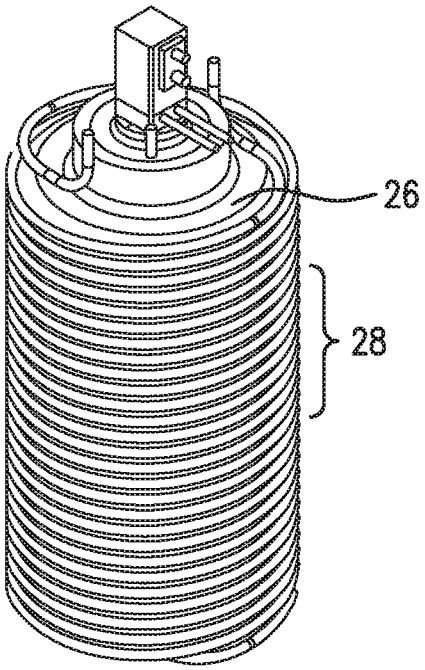
FIG. 7 is a perspective view illustrating cooling calls that are present within the primary heat sink shown in FIGS. 1, 2, and 6.
Figure 8:
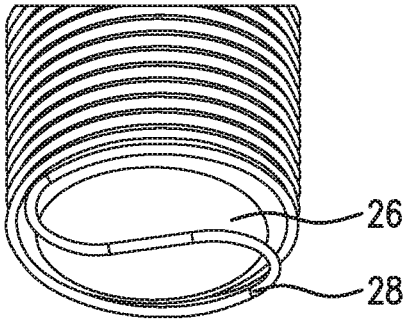
FIG. 8 is a partial, bottom perspective view illustrating the cooling coils shown in FIG. 7.

Further details of the liquid nitrogen-based heat sink 14 are illustrated in FIGS. 2-8. As best illustrated in FIGS. 3 and 7, the liquid nitrogen-based heat sink 10 includes a first vessel 26, which contains an operating supply of liquid nitrogen. Suitably, the first vessel 26 has a double-wall construction, with the space between the inner and outer walls of the first vessel 26 being filled with an insulating material such as an aerogel. The objective of including an aerogel is not to completely inhibit heat transfer across the wall structure of the first vessel 26; rather, it is to regulate heat transfer—and thereby determine performance specifications for the liquid nitrogen-based heat sink 14—by providing a known thickness of the material, since aerogels have easily quantifiable heat-transfer characteristics. Suitably, the first vessel 26 is constructed from aluminum, which has an excellent strength-to-weight ratio and suitable heat-transfer characteristics; which is extremely common; and which is therefore relatively inexpensive.

As further illustrated in FIGS. 3, 5, 7, and 8, a number of coils 28, which are part of the cooling circuit 12, are wrapped around the first vessel 26. The coils 28 are suitably tack-welded to the exterior surface of the first vessel 26 at regular intervals along the length of the coils 28 to ensure good thermal contact between the coils 28 and the first vessel 26. Thus, it will be appreciated that heat that has been absorbed by the propylene glycol within the cooling circuit 12 (from the device or area that is to be cooled) will be transferred through the walls of the coils 28 and the walls of the first vessel 26 to be absorbed by the liquid nitrogen within the vessel 26 as the propylene glycol circulates around the periphery of the first vessel 26.

As the liquid nitrogen absorbs heat, it vaporizes into the headspace within the vessel 26. As noted above, the nitrogen vapor is cooled by the cold head 18 of helium-based cryo-refrigeration system 20—the cold head 18 extends into the interior of the first vessel 26—and condenses back into liquid form, which drips back into the supply of liquid nitrogen.

Furthermore, the first vessel 26 and surrounding coils 28 are suitably contained within a second, outer vessel 30. Like the first vessel 26, the second vessel 30 also suitably has a double-wall construction, with the space between the inner and outer walls of the second vessel 30 being filled with an insulating material such as an aerogel. Additionally, at least a partial vacuum is suitably drawn in the space 32 between the first and second vessels 26, 30, i.e., the space in which the coils 28 are located. The combination of (partial) vacuum between the walls of the first and second vessels 26, 30 and insulating material such as aerogel between the inner and outer walls of the second, outer vessel 30 significantly limits—perhaps even eliminating—heat transfer into the propylene glycol in the coils 26 from the ambient atmosphere.

Based on models we have conducted, it costs significantly less to cool a large-scale system using a cooling system as described above than it costs to cool the same system using a conventional cooling system. For example, according to our calculations, a large-scale server system with 350,000 watts of computing power requires 1.2 million BTU of cooling capability. Current technology like that described in the background section above requires 352,000 watts to run a suitably sized cooling system at a cost (based on local energy rates) of almost $22,000 per month, whereas a system as per the invention only requires 2,500 watts (to drive the circulation pump 18 and the cryo-refrigeration unit 20) to run a suitably sized system at a cost on the order of $155 per month. Such savings are deemed to be highly significant.

What is claimed is:

1. A liquid nitrogen-based cooling system, comprising:

a heat sink containing a first heat-absorbing medium comprising a supply of liquid nitrogen;

a closed-loop cooling circuit through which circulates a non-cryogenic second heat-absorbing medium, the closed-loop cooling circuit being configured and arranged such that the second heat-absorbing medium flows toward and absorbs heat from a device or region to be cooled and then back toward the heat sink, the closed-loop cooling circuit further being arranged in heat-exchanging relationship with the heat sink such that the heat absorbed by the second heat-absorbing medium is transferred to the liquid nitrogen, thereby causing a portion of the liquid nitrogen to vaporize within the heat sink; and a refrigeration subsystem arranged relative to the heat sink to condense nitrogen that has vaporized within the heat sink back into liquid nitrogen and return the condensed nitrogen to the supply of liquid nitrogen;

wherein the heat sink comprises at least a first vessel in which the liquid and vaporized nitrogen are confined, such that the nitrogen cycles between its liquid and vapor phases within the confines of the first vessel, and a plurality of coils arranged in heat-transferring relationship with the liquid nitrogen, the plurality of coils forming a portion of the closed-loop cooling circuit through which the second heat-absorbing medium circulates;

wherein the first vessel is a double-wall vessel and the plurality of coils are arranged on the exterior of the double-wall vessel, thereby transferring heat with the liquid nitrogen.

2. The cooling system of claim 1, wherein the plurality of coils pass around an exterior surface of the first vessel.

3. The cooling system of claim 1, wherein the first vessel and the plurality of coils are disposed within a second, outer vessel, with at least a partial vacuum between the first and second vessels and at least a portion of the coils being disposed within the at least partial vacuum.

4. The cooling system of claim 1, wherein the refrigeration subsystem comprises a helium-based cryo-refrigeration system having a cold head that extends into an interior region within the first vessel, the cold head providing a surface on which the vaporized nitrogen condenses back into liquid nitrogen.

5. The cooling system of claim 1, wherein the second heat-absorbing medium comprises propylene glycol.

6. The cooling system of claim 5, wherein the second heat-absorbing medium comprises a mixture of propylene glycol and one or more anticorrosive agents.

7. A method for cooling a device or region of space requiring cooling, comprising:

circulating a heat-absorbing medium within a closed-loop cooling circuit, the heat-absorbing medium flowing in a direction from a heat sink toward the device or region of space requiring cooling and back toward the heat sink, the heat sink comprising a double-wall vessel containing therein a supply of liquid nitrogen;

causing or allowing heat to be transferred from the device or region of space requiring cooling to the heat-absorbing medium that is circulating within the closed-loop cooling circuit;

transporting the heat, via the heat-absorbing medium, to the heat sink;

causing or allowing the heat being transported by the heat-absorbing medium to be transferred from the heat-absorbing medium to the liquid nitrogen contained within the double-wall vessel by coils that pass around an exterior of the double-wall vessel to thereby transfer heat to the liquid nitrogen and cause at least a portion of the liquid nitrogen to vaporize within the double-wall vessel;

removing heat from the vaporized nitrogen to thereby cause the vaporized nitrogen to condense back to liquid form; and returning the nitrogen that has been condensed back to liquid form to the supply of liquid nitrogen contained within the double-wall vessel, wherein the nitrogen cycles between its liquid and vapor phases within and limited to the confines of the double-wall vessel.

8. The cooling system of claim 1, wherein the second heat-absorbing medium circulates in liquid form.

9. The cooling system of claim 1, wherein the first vessel comprises an insulating material between the two walls of the double-wall.

10. The cooling system of claim 9, wherein the insulating material comprises an aerogel.

11. The cooling system of claim 1, wherein the double-wall regulates heat transfer into and out of the first vessel.

12. A liquid nitrogen-based cooling system, comprising:

a heat sink containing a first heat-absorbing medium comprising a supply of liquid nitrogen;

a closed-loop cooling circuit through which circulates a second heat-absorbing medium, the closed-loop cooling circuit being configured and arranged such that the second heat-absorbing medium flows toward and absorbs heat from a device or region to be cooled and then back toward the heat sink, the closed-loop cooling circuit further being arranged in heat-exchanging relationship with the heat sink such that the heat absorbed by the second heat-absorbing medium is transferred to the liquid nitrogen, thereby causing a portion of the liquid nitrogen to vaporize within the heat sink; and a refrigeration subsystem arranged relative to the heat sink to condense nitrogen that has vaporized within the heat sink back into liquid nitrogen and return the condensed nitrogen to the supply of liquid nitrogen;

wherein the heat sink comprises at least a first vessel in which the liquid and vaporized nitrogen are confined, such that the nitrogen cycles between its liquid and vapor phases within the confines of the first vessel, the first vessel being a double-wall vessel, and a plurality of coils arranged in heat-transferring relationship around the exterior of the first vessel to transfer heat with the liquid nitrogen, the plurality of coils forming a portion of the closed-loop cooling circuit through which the second heat-absorbing medium circulates.

13. The cooling system of claim 12, wherein the second heat-absorbing medium comprises a non-cryogen.

14. The cooling system of claim 13, wherein the second heat-absorbing medium comprises propylene glycol.

15. The cooling system of claim 12, wherein the first vessel further comprises an insulator between the double walls of the double-wall.

16. The cooling system of claim 15, wherein the insulator comprises an aerogel.

* * * * *